US005197854A

United States Patent [19]

Jordan

[11] Patent Number: 5,197,854

[45] Date of Patent: Mar. 30, 1993

[54] AXIAL FLOW FAN

[75] Inventor: Lynvel R. Jordan, Monterey, Calif.

[73] Assignee: Industrial Design Laboratories, Inc., Chula Vista, Calif.

[21] Appl. No.: 755,433

[22] Filed: Sep. 5, 1991

[51] Int. Cl.[5] ..... F04D 29/66; F04D 19/00; F04D 29/26

[52] U.S. Cl. ..... 415/119; 415/222; 416/DIG. 2; 416/DIG. 5

[58] Field of Search ..... 415/119, 222; 416/223 R, DIG. 2, DIG. 5

[56] References Cited

U.S. PATENT DOCUMENTS

| | | | |
|---|---|---|---|
| 1,497,408 | 6/1924 | Seelig | 415/207 |
| 1,924,621 | 8/1933 | Mueller . | |
| 2,337,861 | 12/1943 | Adamtchik . | |
| 2,435,645 | 2/1948 | Bergstrom . | |
| 2,698,128 | 12/1954 | Ault et al. . | |
| 2,701,682 | 2/1955 | Dallenbach et al. . | |
| 2,811,303 | 10/1957 | Ault et al. | 416/223 |
| 2,926,838 | 3/1960 | Van Rijn . | |
| 3,303,995 | 2/1967 | Boeckel . | |
| 3,334,807 | 8/1967 | McMahan . | |
| 3,346,174 | 10/1967 | Lievens et al. | 415/119 |
| 3,565,548 | 2/1971 | Fowler et al. | 416/223 |
| 3,697,193 | 10/1972 | Phillips | 416/223 |
| 3,937,594 | 2/1976 | Ito et al. | 416/223 A |
| 3,976,393 | 8/1976 | Larson | 415/119 |
| 4,055,947 | 11/1977 | Gongwer | 60/221 |
| 4,080,102 | 3/1978 | Schwab | 416/223 A |
| 4,411,598 | 10/1983 | Okada | 416/223 R |
| 4,431,376 | 2/1984 | Lubenstein et al. | 416/223 A |
| 4,482,302 | 11/1984 | Grignon | 417/354 |
| 4,569,632 | 2/1986 | Gray, III | 416/189 |
| 4,796,836 | 1/1989 | Buchelt | 244/23 R |
| 4,911,612 | 3/1990 | Rodde et al. | 416/223 R |
| 4,927,331 | 5/1990 | Vuillet | 416/238 |
| 5,066,194 | 11/1991 | Amr | 415/208.2 |

FOREIGN PATENT DOCUMENTS

| | | | |
|---|---|---|---|
| 1923535 | 1/1970 | Fed. Rep. of Germany | 416/DIG. 2 |
| 27845 | 10/1972 | Japan | 416/DIG. 2 |
| 206296 | 9/1987 | Japan | 415/119 |
| 399643 | 3/1966 | Sweden . | |
| 732580 | 5/1980 | U.S.S.R. . | |

OTHER PUBLICATIONS

Axial Flow Fans Design and Practice by R. A. Wallis, 1961.

Mechanics and Thermodynamics of Propulsion, Philip G. Hill and Carl R. Peterson, 1965.

The Theory and Design of Gas Turbines and Jet Engines, by E. T. Vincent, 1950.

*Primary Examiner*—Edward K. Look
*Assistant Examiner*—Michael S. Lee
*Attorney, Agent, or Firm*—Pretty, Schroeder, Brueggemann & Clark

[57] ABSTRACT

An axial flow fan operates with increased efficiency, reduced noise, and improved resistance to stall. These benefits are achieved by providing a fan shroud with a bellmouth and a hub with a curved bellmouth wherein both have a substantially parabolic shape, and by providing a blade shape with an air pressure distribution that promotes smooth airflow and resists stall. The blade is provided with a twist that varies with distance from the blade root such that the work done on the air moved by the blade, whether at the blade root or tip, is substantially equal.

16 Claims, 3 Drawing Sheets

AXIAL FLOW FAN

BACKGROUND OF THE INVENTION

1. Field of the Invention

This invention relates generally to axial flow fans and, more particularly, to high efficiency axial flow fans that operate with reduced fan airflow turbulence and lower noise.

2. Description of the Related Art

Axial flow fans are used to ventilate and cool a great variety of areas, from personal computer cases to entire buildings. Axial flow fans include a multi-bladed impeller and may or may not include a shroud, which helps direct air past the blades. When the impeller is rotated by a fan motor, the pressure of the air passing through the blades is reduced, which causes continuous air movement toward the fan. The fan blades then raise the pressure and move the air out the rear of the fan. The moving air creates a steady flow that can be used to ventilate and cool particular areas.

Although axial flow fans are useful in ventilating and cooling, they conventionally are limited to a maximum 60% to 65% operating efficiency. For many devices that must be cooled, the component that requires the greatest amount of power for operation is the fan. Therefore, improving the efficiency of the fan can greatly improve the overall efficiency of such devices.

Much of the inefficiency of conventional fans is due to turbulence in the airflow as it is moved past the fan blades and as it exits the fan shroud. Turbulence is a random flow of air through the fan rather than a directed flow and, as a result, the fan motor must expend energy to overcome the turbulence and move the air through the fan. The turbulence also creates a great deal of unwanted noise. Fans used in small appliances and personal computers, for example, can produce noise that intrudes upon an otherwise relatively quiet environment. On a larger scale, care must be taken in large buildings to isolate the building occupants from the noise generated by the fans of the heating, ventilating, and air conditioning systems.

Another limitation of conventional fans is that most have a relatively narrow range of operating speeds and conditions. If the airflow through a fan is below the minimum required by the operating range of the fan, a stall condition can occur in which the air ceases to flow smoothly over the surfaces of the fan blades and violently separates from the blades. The violent separation of airflow greatly increases the turbulence, which reduces the airflow and pressure rise through the fan and increases the noise generated by the fan. In severe cases of stall, high vibration can be generated that can destroy the fan.

Finally, the accumulation of dirt, dust, insects, and the like on the fan blades reduces the performance of the fan by reducing both airflow and pressure rise through the fan. These reductions in turn decrease the fan efficiency and increase the fan noise level. Extreme cases of dirt, dust, and insect accumulation can reduce the airflow sufficiently to cause the fan to enter a severe stall that can destroy the fan if it is left to operate under such conditions.

From the foregoing discussion, it should be apparent that there is a need for an axial flow fan that provides increased efficiency and reduced noise over a relatively wide range of operating conditions. The present invention satisfies this need.

SUMMARY OF THE INVENTION

The present invention provides an axial flow fan that is configured to significantly reduce the turbulence experienced by air as it is moved into the fan and past the fan blades. The turbulence is reduced by providing a fan shroud and hub with rounded bellmouth surfaces that substantially conform to the path of air coming into the fan and therefore smooth the airflow as the air moves past the bellmouth surfaces. The turbulence is further reduced by configuring the fan blades to ensure that the blades have pressure distribution and stall characteristics that encourage smooth airflow and to ensure that the air velocity at the blade hub is nearly equal to the air velocity at the blade tips. An axial flow fan constructed with these features achieves an operating efficiency of greater than 80% and operates over a greater range of conditions without suffering from fan stall, with reduced noise, in comparison with conventional fans of comparable output.

In accordance with the present invention, the fan shroud extends from forward of the leading edges of the fan blades to a point beyond the trailing edges of the fan blades, and the shroud bellmouth is given a curvature that is defined by a generally parabolic or elliptical shape. In particular, the shape of the shroud bellmouth is given by the equation $y=(2px)^{\frac{1}{2}}$, where x is the axial distance along the inner surface of the shroud, y is the distance perpendicular to the x-axis, with the origin at the leading edge of the shroud where the axes intersect, and p is a predetermined constant that determines the curvature of the parabola of the shroud bellmouth.

The hub is provided with a relatively flat center surface and a circumferential, curved bellmouth surface that follows a parabola similar to that of the shroud bellmouth, where y is the axial distance along the outer surface of the hub, x is the distance perpendicular to the y-axis, with the origin at the flat face of the hub where the axes intersect, and p is a predetermined constant that determines the curvature of the parabola of the hub bellmouth. As a manufacturing expedient, the parabolic shape of both the shroud bellmouth and hub bellmouth can be approximated by a circle having a diameter that has been selected to coincide with the respective parabolic shapes over approximately 90° of arc. The circular shape is much easier to manufacture than the parabolic shape, but provides a great deal of the benefits that could be obtained with the parabolic shape.

Additional reductions in turbulence are obtained by giving the fan blades an airfoil shape with varying thickness and a rounded leading edge that is drooped, rather than giving them a conventional constant thickness, circular arc shape. The blade is shaped to provide a pressure distribution such that, for a stagnation pressure at the leading edge of a blade equal to zero, the pressure continuously decreases on the upper surface from zero to a peak negative value at a point in the range of the first 20% to 30% of the blade chord, and then smoothly increases over the aft two-thirds of the upper surface to a positive value at the trailing edge of the blade, and is continuously positive on the lower surface. As a result, any stall in the airflow tends to start near the trailing edge of the blade rather than at the leading edge, as is conventional. Additionally, when a stall condition does result, the stall tends to move progressively toward the leading edge and tends to be milder than otherwise experienced.

The desired pressure distribution and stall characteristics are also achieved by giving the trailing edge of each fan blade a blunt, squared-off shape that reduces the operating noise level, prevents the airflow over the blade toward the trailing edge from separating and creating a violent stall, and causes the airflow to leave the trailing edge of the blade smoothly, as a sheet.

Finally, the blades are given a twist relative to their radial chord axis, from the hub to the tip, such that the velocity of air moving over the blade is approximately equal from the hub to the blade tip, despite the fact that the linear speed of the blade at the tip is much greater than the linear speed of the blade at the hub. A fan blade constructed in accordance with the present invention can operate satisfactorily over a much greater range of airflow and blade angle of attack without stall when compared with conventional fan blades.

Other features and advantages of the present invention should be apparent from the following description of the preferred embodiment, which illustrates, by way of example, the principles of the invention.

DESCRIPTION OF THE PREFERRED EMBODIMENTS

Figure 1:
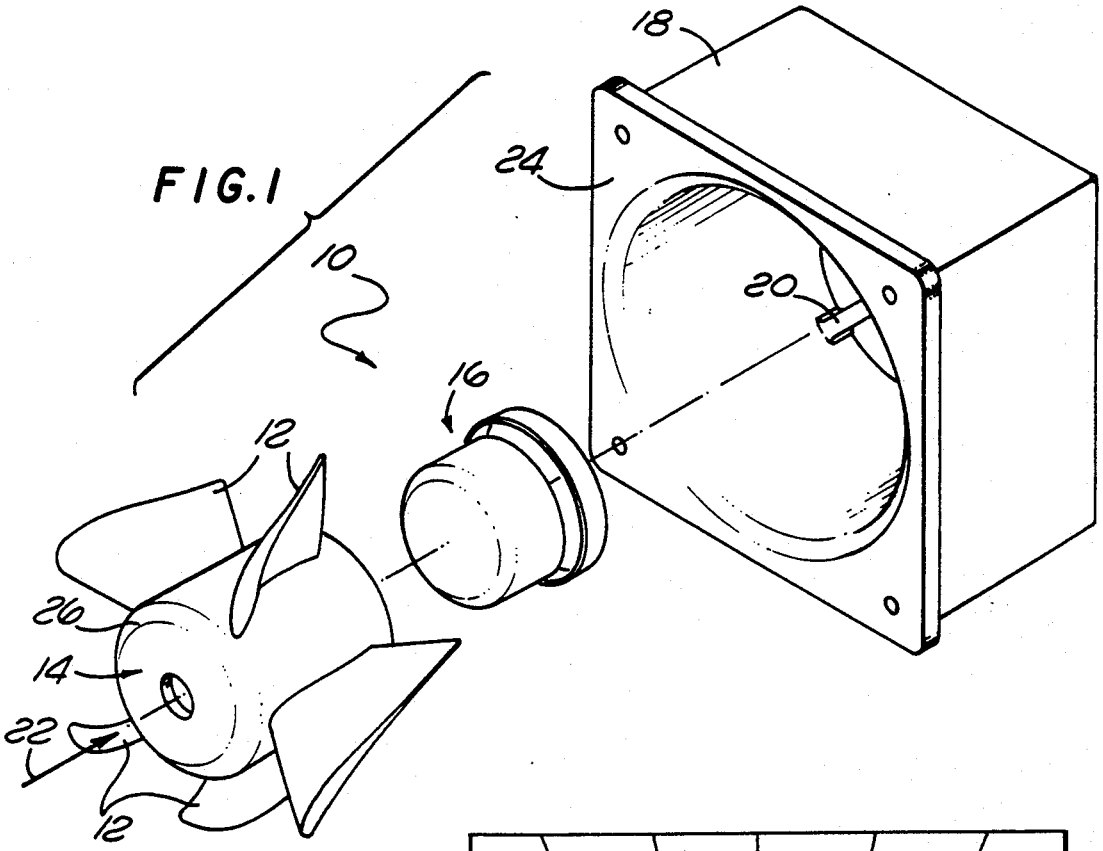
FIG. 1 is an exploded perspective view of an axial flow fan constructed in accordance with the present invention.

An axial flow fan 10 in accordance with the present invention is illustrated in FIG. 1 and includes a plurality of fan blades 12 attached to a hub 14 that is coupled to and rotated by a motor 16. The hub and fan blades rotate within a fan shroud 18 having front and rear openings. The motor is mounted on or to a motor mount 20, which is attached to the inner surface of the shroud. When the motor turns and the fan blades and hub rotate, air is moved from a stagnant, still air region in front of the fan 10 into the shroud 18 in the direction of the arrow 22. An annular shroud bellmouth 24 covers the forward end of the shroud and is provided with a rounded circumferential surface that helps smooth the airflow into the shroud and reduce turbulence. The reduced turbulence increases the efficiency of the fan 10. The hub 14 likewise has a rounded circumferential front surface 26 that helps smooth the airflow past the hub and reduce turbulence through the shroud. The fan blades 12 are provided with a shape that further helps reduce turbulence and encourages the smooth flow of air through the shroud. As a result of the reduced air turbulence, the operating efficiency of the fan is increased when compared with conventional fans, and efficiencies greater than 80% can be achieved.

Figure 2:
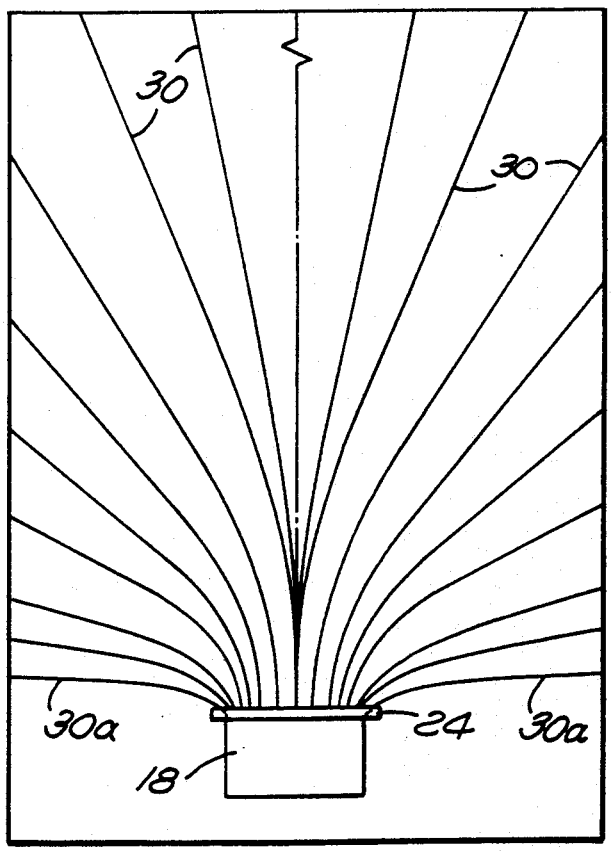
FIG. 2 is a plan representation of the airflow into the fan illustrated in FIG. 1.

FIG. 2 shows a plan view of the fan 10 with curves 30 drawn to represent the flow of air from various stagnation points far in front of the fan, where the air is still and at atmospheric pressure, into the fan shroud. The curves 30 have a parabolic shape given by the equation $$y=(2\,p\,x)^{\frac{1}{2}}$$

where, for each parabola, x is the axial distance perpendicular to the forward surface of the fan shroud 18, y is the perpendicular distance from the x-axis to the parabola, and p is a constant term. The intersection of the x and y axes is the origin point of each parabola. Those skilled in the art will recognize that each parabola is associated with a different p value and that the p value for the airflow curve whose x axis is aligned with the inside surface of the shroud 18 will vary depending on the flow and velocity requirements of the fan. In particular, for a fan operating at approximately 3000 rpm and having a shroud with an inside diameter of approximately 4.50 inches, the p value for the flow curve **30*a*** whose x axis is aligned with the inside surface of the shroud is approximately 0.60.

Thus, as the fan blades 12 rotate, air is moved into the shroud 18 along the curved flow patterns 30 illustrated in FIG. 2. Air attempts to flow into a conventional fan in the same manner, but does not achieve the reduced turbulence of the present fan 10 after entering the shroud, as described below. The curved surfaces of the shroud bellmouth 24 and hub 14 illustrated in FIG. 1 encourage the airflow into the shroud past the bellmouth to be smooth and to follow the natural flow pattern of air into the shroud illustrated by the curves 30 in FIG. 2.

Figure 3:
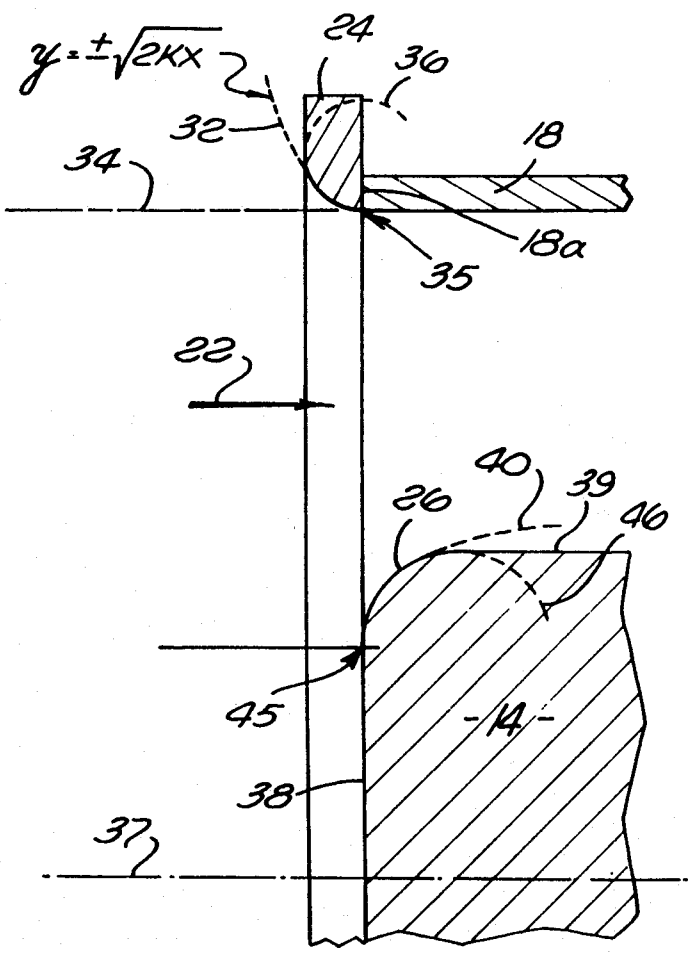
FIG. 3 is a cross-sectional view of the fan shroud and bellmouth and of the fan hub illustrated in FIG. 2.

FIG. 3 is an enlarged, plan sectional view of the shroud bellmouth 24 and hub 14. Again, the flow direction of incoming air is indicated by the arrow 22. The curved surface of the bellmouth is easily seen in FIG. 3 and, in particular, generally follows the shape of a parabola identified by the reference numeral 32 and given by the equation $$y=(2\,p\,x)^{\frac{1}{2}}$$

where x is the axial distance from the forward edge of the fan shroud 18 along the inner cylindrical surface of the shroud, y is the perpendicular distance from the x-axis to the parabola, and p is a constant term equal to 0.60. The x-axis is indicated in FIG. 3 by the line identified by the reference numeral 34 and the y-axis is aligned with the front surface **18*a* of the shroud. The intersection of these two axes 35 is the origin point of the parabola. Thus, the value of p is selected to most closely correspond to the shape of the parabola that matches the airflow pattern for air entering the shroud, as illustrated in FIG. 2** and described above. As a result, the bellmouth shape conforms to the curved path followed by the air entering the shroud, reduces any disruption in airflow caused by air striking the shroud bellmouth, and therefore minimizes turbulence in the airflow downstream from the bellmouth.

As a manufacturing expedient, the parabolic shape desired for the shroud bellmouth 24 is approximated by a circular shape. A circle indicated in FIG. 3 by the dashed line 36 substantially coincides with the parabola 32 over the first 90° of arc. A circular radius can be easily manufactured, either by molding or machining, whereas a parabolic shape is relatively difficult to manufacture. It has been found that a significant reduction in downstream air turbulence, and therefore a great deal of the benefits that could be obtained with the parabolic shape, can be obtained by providing the curved surface of the shroud bellmouth 24 with a radius that substantially coincides with the parabolic function over the first 90° of arc.

The fan hub 14 is provided with a curved surface in a similar manner to the shroud bellmouth. Although only half of the hub is illustrated in FIG. 3, it is to be understood that the hub is symmetric in cross-section about the centerline 37 of the hub and shroud. The front center surface 38 of the hub is flat and does not project beyond the front edge of the fan shroud 18. By not extending beyond the fan shroud, the front surface of the hub is kept flush with the minimum section through the shroud. This keeps the pressure field between the hub and the shroud substantially uniform, which contributes to minimal airflow turbulence.

The curved surface between the front surface 38 of the hub 14 and the cylindrical side surface 39 of the hub generally follows the shape of a parabola 40 that is given by the equation $$y=(2\,p\,x)^{\frac{1}{2}}$$

where y is the axial distance along the outer surface of the hub, x is the distance perpendicular to the y-axis, with the origin at the flat face 38 of the hub, and p is a constant term equal to 1.00. The x-axis of the hub parabola is indicated in FIG. 3 by the line identified by the reference numeral 42 and the y-axis corresponds to the line identified by the reference numeral 44. The intersection of these two axes 45 is the origin point of the parabola 40. The value of p is selected to provide a parabola that most closely matches the path of air flowing off the flat front surface 38 of the hub. Once again, the parabolic surface can be approximated by a circle 46 such that the circle has a radius that substantially coincides with the parabolic function over the first 90° of arc.

The reduced turbulence through the fan 10 is achieved not only with the shroud and hub bellmouths, but also with an improved fan blade that provides a pressure distribution with improved resistance to stall, reduced turbulence, and an advantageous airflow off the trailing surfaces of the blade. All of these blade design features combine with the shroud bellmouth and hub bellmouth to reduce turbulence in the airflow through the fan 10.

Figure 4:
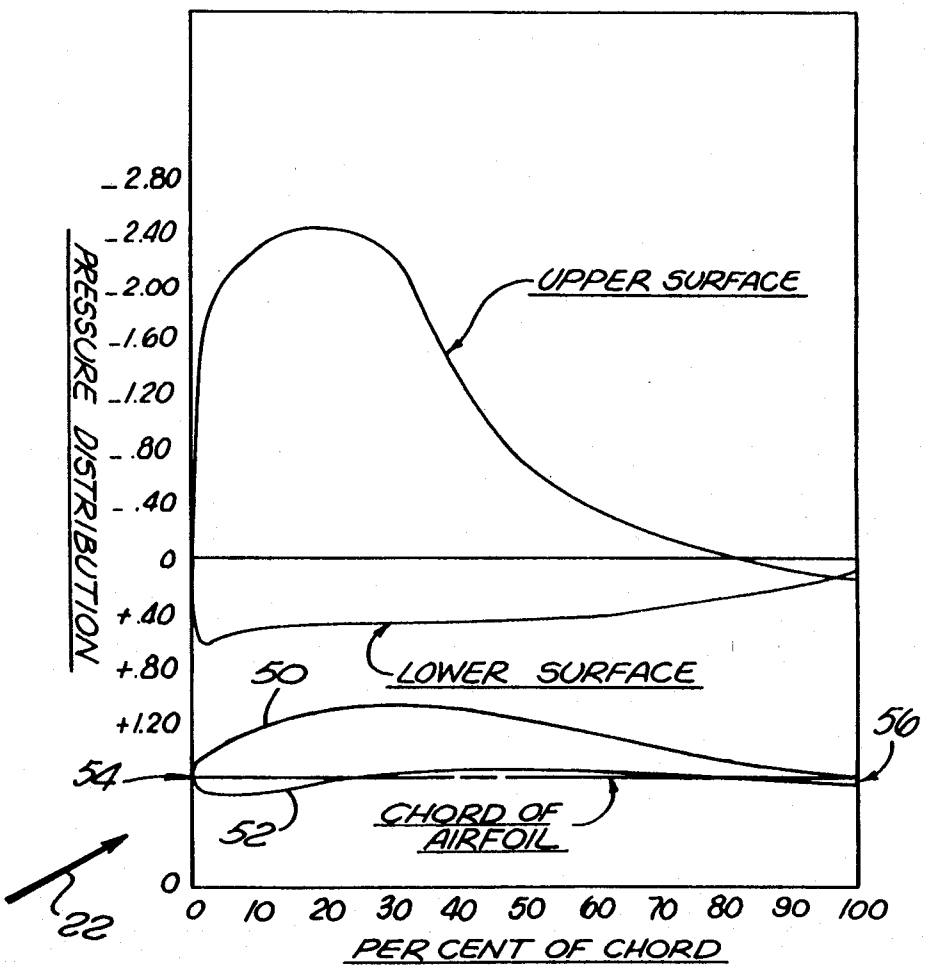
FIG. 4 is diagram showing the pressure distribution around the surface of the blade for a cross section of the blade illustrated at the bottom of FIG. 4.

FIG. 4 shows a cross-sectional view of a fan blade 12 in accordance with the invention in the lower part of the drawing, with a chart of the corresponding pressure distribution around the blade in the upper part of the drawing. Rather than being shaped as a conventional curved arc blade, the novel blade is given an airfoil shape with a rounded and drooped nose that maximizes the smooth flow of air over its surface. In particular, the blade cross-section in the lower part of FIG. 4 shows that the top surface 50 of the fan blade 12 meets the lower surface 52 of the fan blade along a leading edge 54 and that the blade is thicker in cross-section near the leading edge and gradually tapers to a thinner cross-section at the trailing ends of the upper and lower surfaces. The shape of the upper surface is specifically configured to provide resistance to stall, which is a violent separation of airflow from along the surface of the blade and is accompanied by a rapid reduction in air velocity and severe turbulence.

Axial flow fans typically use circular arc blades of relatively constant thickness, which can tolerate approximately a 10% reduction in airflow velocity before the onset of stall. It has been found that a fan constructed with the fan blade 12 of the present invention can withstand a reduction of approximately 65% in the airflow before the onset of fan stall. Thus, an axial flow fan constructed in accordance with the present invention can better resist fluctuations in the condition of the blade surfaces and in operating speed without entering stall. Moreover, blades in accordance with the invention can be designed to provide a shape and angle-of-attack that are closer to the onset of stall than conventional blades, and can thereby provide increased performance.

The graph in the upper part of FIG. 4 illustrates the pressure distribution (static pressure/dynamic pressure) obtained with the shape of the blades 12. As known to those skilled in the art, the leading edge of a blade is defined to be the stagnation point on the blade when it is oriented with the oncoming airflow. The stagnation point is the point of maximum pressure measured at the forward surface of a blade, and is set to zero in a plot of pressure distribution. The forward portion of the blade 12 is drooped, or canted downward, to provide the upper surface 50 with a curvature such that the pressure distribution quickly decreases from zero to a maximum negative value of approximately −2.40, with a relatively broad, flat peak at between 10% and 20% of the blade chord from the leading edge 54. The droop of the forward portion generally aligns that part of the blade with the airflow 22 and helps to reduce the accumulation of dirt, dust, and insects on the blade. The curvature of the upper surface is then adjusted such that the air pressure at the blade surface starts becoming a smaller negative value at between 25% and 35% of the blade chord and smoothly decreases so that the pressure continues to gradually become a smaller negative value, becomes zero, and finally becomes slightly positive at approximately 0.20 near the end of the upper surface 50.

The lower surface 52 of the fan blade 12 is shaped so that the air pressure quickly increases from zero at the leading edge 54 to a positive value between 0.40 and 0.80, and is maintained at substantially the same value until near the end of the lower surface, where the distribution reaches a value of approximately 0.20. The lower surface is shaped to provide as uniform and flat a pressure distribution as possible, thereby minimizing any instability in the airflow.

With the pressure distribution shown in FIG. 4, any separation of airflow from around the upper surface 50 of the fan blade 12 will most likely begin near the trailing surface 56 of the blade where the pressure becomes positive. This is in direct contrast to conventional blade shapes, in which stall typically begins near the leading edge of the blade and spreads rearward. It should be appreciated that a stall that begins near the leading edge will more likely disrupt the airflow over the remainder of the blade surface and cause catastrophic separation of airflow from the blade. The stall typically encountered with the fan blade 12 in accordance with the present invention is especially mild and will not generally result in a catastrophic separation of airflow, which can produce violent vibration and even destruction of the fan.

The shape of the blade 12 at the trailing ends of the upper and lower surfaces 50 and 52 also contribute to smoother airflow and reduced turbulence. FIG. 4 shows that the upper and lower blade surfaces end in blunt corners that are connected by a flat end surface 56 that extends between the two. Because the air pressure, as shown in the pressure distribution chart, has a positive value at the trailing end of the upper surface and at the trailing end of the lower surface, the air pressure in the flat region between the two and past the blade will have a negative value. The suction created in this region tends to keep the airflow from the upper and lower surfaces close together in a smooth, sheet-like flow off the blade, which minimizes turbulence.

Because the fan blades 12 are rotating about a central axis, the blade tip located farthest from the hub 14 will necessarily have a greater linear speed than the blade root located adjacent the hub. To promote smoother airflow through the fan and further reduce turbulence, the fan blades 12 are provided with a twist along their radial length such that the air moved by the blades is imparted with an equal velocity and pressure regardless of the radial distance from the hub. That is, the blade chord at the tip is rotated relative to the blade chord at the hub. With equal air velocity and pressure, the work done by the blade on the air, whether at the hub or at the tip, is nearly the same. The twist necessary to achieve equal work from hub to tip is advantageously determined experimentally.

Figure 5:
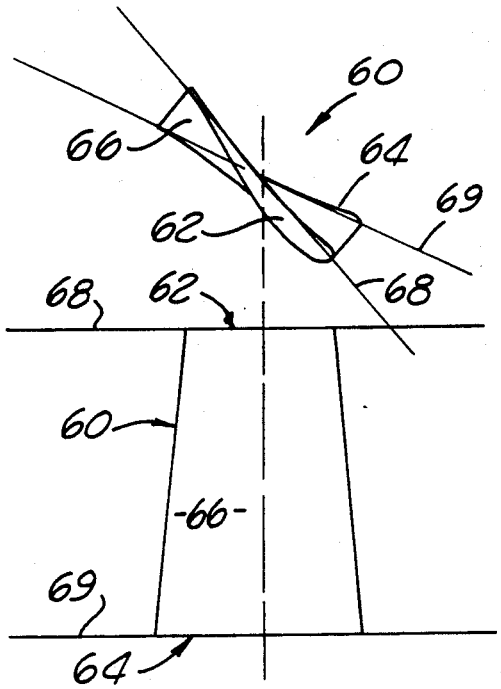
FIG. 5 is a perspective view of a blade constructed in accordance with the present invention in the upper part of the drawing, along with a plan view of the blade in the lower part of the drawing.
Figure 6:
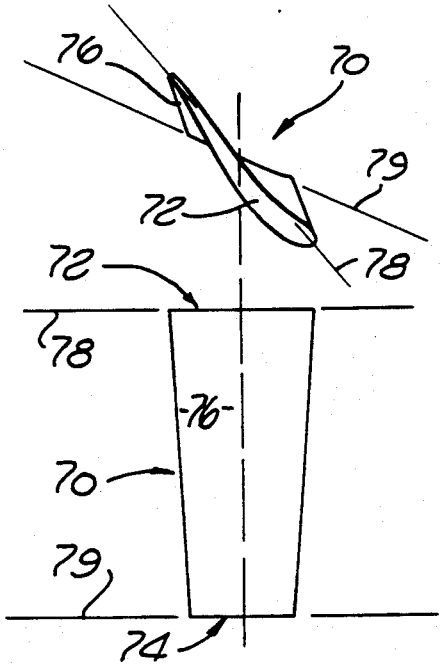
FIG. 6 is a perspective view in the upper part of the drawing and a plan view in the lower part of the drawing of an alternate construction of the blade illustrated in FIG. 5.

A perspective view of a blade 60 in accordance with the present invention is shown in the upper part of FIG. 5 looking down the blade from the blade tip 62 toward the blade root 64, with a view of the blade upper surface 66 in the lower part of FIG. 5. The blade chord at the blade tip is equal to the blade chord at the root, near the hub 14. The chord line 68 at the tip and the chord line 69 at the root are indicated in the upper part of FIG. 5 to better illustrate the twist of the blade. Alternatively, to maximize the blade surface area, a blade 70 shown in FIG. 6 is shaped so that the chord of the blade is greater at the blade tip 72 than at the blade root 74 near the hub. Such an arrangement of fan blades is advantageous if the fan blades and hub are to be molded as a single piece, because it eliminates blade overlap. Blade overlap occurs when, viewed axially, the trailing edge of one blade overlaps the leading edge of another blade. If there is blade overlap, then conventional molds for the blades and hub cannot be easily pulled apart, and more costly molding techniques must be used instead. By using blades with a smaller chord at the hub than at the tip, such as illustrated in FIG. 6, the circumferential distance around the hub is much less than around the tips and blade overlap is eliminated. Thus, production costs are reduced.

Figure 7:
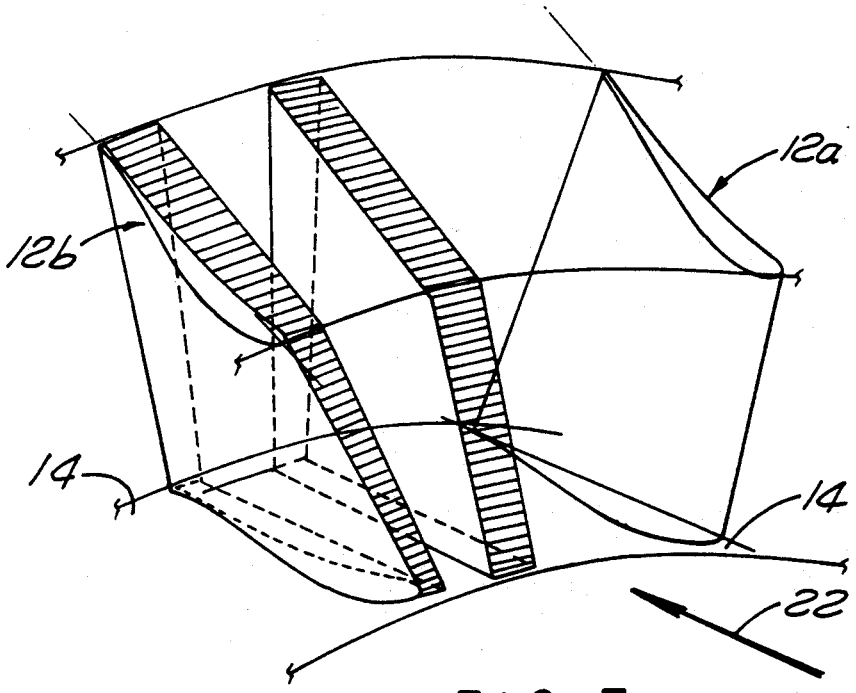
FIG. 7 is a perspective view of two blades of the fan illustrated in FIG. 1, illustrating the analysis of the channel between blades.

Turbulence through the fan is also reduced by adjusting the shape and relative position of the blades 12 on the hub 14 after analysis of the airflow in the channel between blades. As illustrated in FIG. 7, the analysis is performed by dividing the channel between blades into planes that extend from the hub to the blade tip and from the leading edge to the trailing edge. It has been found that dividing the channel into ten planes for analysis provides satisfactory results. The pressure distribution in each plane is checked to ensure that it is continuous and free of abrupt changes, or spikes, between planes.

Referring to FIG. 7, when the airflow enters a channel, it encounters the pressure distribution of the upper surface of one blade **12*a* and the pressure distribution of the lower surface of an adjacent blade 12*b*. For example, by referring to FIG. 4, it can be seen that the air pressure distribution in the channel between two blades at 20% of the blade chord would be approximately −2.40 at one side of the channel due to the upper surface on one blade 12*a*, and would be approximately 0.60 at the other side of the channel due to the lower surface of the other blade 12*b*. A pressure on the upper surface of one blade 12*a* at 0 faces a pressure of approximately 0.40 on the lower surface of another blade 12*b***.

The design goal for the channel between blades is to achieve a pressure distribution that is continuous. For example, where a pressure of 0 from one blade **12*a* faces a pressure of 0.40 from another blade 12*b*, the pressure at half the distance between the blades should be half the difference, or approximately 0.20. Similarly, at one-fourth the distance from one blade 12*a* to the other 12*b***, the pressure difference should be one-fourth, or 0.10. If the analysis of pressure distribution in the channel shows any discontinuity, then modifications can be made in the twist of the blades, the relative spacing of the blades, and the number of blades, depending on the design criteria. The results of the modifications can be checked and further or different modifications, if necessary, can be performed.

A fan constructed in accordance with all of the considerations described above includes shroud and hub bellmouths that conform to the natural flow of air into the fan, blades with airfoil shapes and canted forward portions that reduce the accumulation of debris and resist stall, and are placed relative to each other to have continuous a pressure distribution in the channel between blades. As a result, turbulence through the fan is reduced, the fan achieves efficiencies greater than 80%, and operates with reduced noise.

The present invention has been described above in terms of presently preferred embodiments so that an understanding of the present invention can be conveyed. There are, however, many configurations for axial flow fans not specifically described herein, but with which the present invention is applicable. The present invention should therefore not be seen as limited to the particular embodiments described herein, but rather, it should be understood that the present invention has applicability with respect to axial flow fans in a variety of configurations. All modifications, variations, or equivalent arrangements that are within the scope of the attached claims should therefore be considered to be within the scope of the invention.

I claim:

1. An axial flow fan having a plurality of fan blades mounted on a rotatable hub that is turned by a motor to move air from in front of the fan toward the blades and past the fan, the fan further comprising:

a shroud that circumferentially surrounds the hub and fan blades and that extends from the front surface of the hub to beyond the rear edge of the blades;

a shroud bellmouth around the front surface of the shroud that directs the air moving from in front of the fan into the fan shroud in a smooth flow;

wherein the shroud bellmouth has an outer surface that is defined substantially by the relationship $$y=(2px)^{\frac{1}{2}}$$

where x=axial distance along the inner cylindrical surface of the shroud from the forward edge of the shroud y=radial distance perpendicular from the plane of the shroud inner cylindrical surface to the curved surface of the shroud bellmouth p=predetermined constant that corresponds to the value for the equivalent parabola that coincides with the airflow pattern for air entering the shroud; and a generally cylindrical hub having a relatively flat center front surface and a curved surface from the hub center to the hub side surface that is defined substantially by the relationship $$y=(2px)^{\frac{1}{2}}$$

where y=axial distance along the outer surface of the hub to the curved surface x=radial distance perpendicular to the y-axis from the front surface of the hub p=predetermined constant equal to approximately 1.00.

2. A fan as defined in claim 1, wherein the fan blades are configured such that a pressure distribution around the upper surface of each blade varies continuously from zero at the leading edge of the blade, to a peak negative value in the forward third of the blade chord, and to an increasing value that ends with a positive value at the trailing end of the blade.

3. A fan as defined in claim 2, wherein the pressure distribution over the upper surface of the rear two-thirds of the blade chord has a continuously decreasing gradient from the peak negative value to zero and to the positive value at the trailing edge.

4. A fan as defined in claim 2, wherein the top surface of the fan blade and the bottom surface of the fan blade meet at a trailing surface that is flat and squared off.

5. A fan as defined in claim 1, wherein the upper surface of each fan blade over the forward third of the blade chord is canted downward into the relative flow of air such that the air pressure at the leading edge of the blade is zero and over the surface of the forward third reaches a peak negative value greater than approximately −2.00.

6. A fan as defined in claim 5, wherein the blade is twisted about a radial axis from the blade root to the blade tip.

7. A fan as defined in claim 1, wherein the front surface of the shroud bellmouth is defined by a circle having a radius such that the circumference of the circle is substantially equal to the value of y in the elliptical relationship over a 90 degree arc of the bellmouth beginning with the front surface of the shroud.

8. An axial flow fan having a plurality of fan blades that are attached to a rotatable hub coupled to a motor such that air is moved from in front of the fan toward the blades and past the fan when the motor rotates the hub, the fan further comprising:

a shroud that circumferentially surrounds the hub and fan blades and that extends from the front surface of the hub to beyond the rear edge of the blades;

a shroud bellmouth that extends around the front surface of the shroud and that has a curved front surface defined substantially by the relationship $$y=(2px)^{\frac{1}{2}}$$

where x=axial distance along the inner cylindrical surface of the shroud from the forward edge of the shroud y=radial distance perpendicular from the plane of the shroud inner cylindrical surface to the curved surface of the shroud bellmouth p=predetermined constant that corresponds to the value for the equivalent parabola that coincides with the airflow pattern for air entering the shroud; and a generally cylindrical hub having a relatively flat center front surface and a curved surface from the hub center to the hub side surface that is defined substantially by the relationship $$y=(2px)^{\frac{1}{2}}$$

where y=axial distance along the outer surface of the hub to the curved surface x=radial distance perpendicular to the y-axis from the front surface of the hub p=predetermined constant equal to approximately 1.00;

wherein the fan blades are configured such that a pressure distribution around the upper surface of each blade varies continuously from zero at the leading edge of the blade, increasing in magnitude to a peak negative value in the forward third of the blade chord, having a magnitude of at least approximately 2.00, decreasing in magnitude over the upper surface of the rear two-thirds of the blade chord from the peak negative value to zero and continuing to increase to a positive value at the trailing edge; and wherein the top surface of the fan blade and the bottom surface of the fan blade meet at a trailing surface that is flat and squared off.

9. An axial flow fan having a plurality of fan blades that are attached to a rotatable hub coupled to a motor such that air is moved from in front of the fan toward the blades and past the fan when the motor rotates the hub, wherein:

each blade has a leading edge that represents the stagnation point of the blade which is set to zero in a plot of pressure distribution of the blade, a top surface extending rearwardly from the leading edge, a bottom surface extending rearwardly from the leading edge, the top surface and the bottom surface meeting at a trailing edge surface that is flat and squared off, a chord axis that extends in a straight line from the leading edge to the trailing edge surface and a front portion of the blade that is canted downward with respect to the chord axis;

each blade is further configured such that the pressure distribution around the bottom surface varies continuously from zero at the leading edge to a positive value for the full length of the bottom surface, and the pressure distribution around the top surface varies continuously from zero at the leading edge, increasing in magnitude to a peak negative value in the forward third of the blade chord, decreasing in magnitude over the upper surface of the rear two-thirds of the blade chord from the peak negative value to zero and then increasing to a positive value at the trailing edge; and each blade has a blade root mounted to the hub and a blade tip wherein each blade is twisted from the blade root to the blade tip.

10. An axial flow fan as defined in claim 9, the fan further comprising:

a shroud that circumferentially surrounds the hub and fan blades and that extends from the front surface of the hub to beyond the rear edge of the blades;

a shroud bellmouth around the front surface of the shroud that directs the air moving from in front of the fan into the fan shroud in a smooth flow;

wherein the shroud bellmouth has an outer surface that is defined substantially by the relationship $$y=(2px)^{\frac{1}{2}}$$

where x=axial distance along the inner cylindrical surface of the shroud from the forward edge of the shroud.

y=radial distance perpendicular from the plane of the shroud inner cylindrical surface to the curved surface of the shroud bellmouth p=predetermined constant that corresponds to the value for the equivalent parabola that coincides with the airflow pattern for air entering the shroud; and a generally cylindrical hub having a relatively flat center front surface and a curved surface from the hub center to the hub side surface that is defined substantially by the relationship $$y=(2px)^{\frac{1}{2}}$$

where y=axial distance along the outer surface of the hub to the curved surface x=radial distance perpendicular to the y-axis from the front surface of the hub p=predetermined constant equal to approximately 1.00.

11. A fan as defined in claim 9, wherein the peak negative value on the top surface of the blade is substantially maintained between 10 to 20 percent of the chord axis.

12. A fan as defined in claim 9, wherein the peak negative value on the top surface of the blade is at least approximately 2.00.

13. A fan as defined in claim 9, wherein the peak negative value on the top surface of the blade is at least approximately 2.00, from approximately 3 percent to 32 percent of the chord axis.

14. A fan as defined in claim 9, wherein the pressure distribution on the top surface adjacent the trailing edge surface is approximately +0.20.

15. A fan as defined in claim 9, wherein the pressure distribution of the bottom surface is substantially maintained between 0.40 and 0.80 for approximately 65 percent of the surface.

16. A fan as defined in claim 9, wherein the pressure distribution at the bottom surface adjacent to the trailing edge is approximately +0.20.

* * * * *